US006035781A

United States Patent [19]

Rogge et al.

[11] Patent Number: 6,035,781

[45] Date of Patent: Mar. 14, 2000

[54] DOCTOR BLADE DEVICE FOR AN INK CLEANING UNIT OF A ROTARY PRINTING MACHINE

[75] Inventors: Gunter Rogge, Lienen; Rainer Dembek, Lengerich, both of Germany

[73] Assignee: Windmöller & Hölscher, Lengerich, Germany

[21] Appl. No.: 09/132,431

[22] Filed: Aug. 12, 1998

[30] Foreign Application Priority Data

Aug. 12, 1997 [DE] Germany ..... 197 34 910

[51] Int. Cl.[7] ..... B41F 31/04

[52] U.S. Cl. ..... 101/350.6; 101/364

[58] Field of Search ..... 101/350.6, 366, 101/364, 363

[56] References Cited

U.S. PATENT DOCUMENTS

| | | | |
|---|---|---|---|
| 4,590,855 | 5/1986 | Schommer et al. | 101/350.6 |
| 4,821,672 | 4/1989 | Bruno | 101/366 |
| 5,182,992 | 2/1993 | Rogge | 101/363 |
| 5,243,907 | 9/1993 | Weishew | 101/364 |
| 5,492,058 | 2/1996 | Greive | 101/148 |
| 5,735,210 | 4/1998 | Rogge | 101/366 |
| 5,826,509 | 10/1998 | Deneka | 101/366 |

FOREIGN PATENT DOCUMENTS

| | | |
|---|---|---|
| 30 43 265 | 6/1982 | Germany . |
| 94 05 883 | 7/1994 | Germany . |
| 43 20 833 | 9/1994 | Germany . |
| 195 36 765 | 4/1997 | Germany . |

*Primary Examiner*—Edgar Burr
*Assistant Examiner*—Leslie J. Grohusky
*Attorney, Agent, or Firm*—Jacobson, Price, Holman & Stern, PLLC

[57] ABSTRACT

A doctor blade device for an inking rinse unit of a rotary printing machine, including a doctor blade support, provided with an ink channel, on which two parallel doctor blades that are adjustable in relation to a form linking roller are affixed and—together with the form roller, the doctor blade support and packing pieces, which are made out of an elastomeric material and clamped adjacent to the blades and roller by the support—delimiting a closed ink compartment, and including lines for the transport of ink into and out of the ink compartment. In order to be able to replace the packing pieces quickly and easily, they are held in their seats by clamping quick release closure.

10 Claims, 3 Drawing Sheets

DOCTOR BLADE DEVICE FOR AN INK CLEANING UNIT OF A ROTARY PRINTING MACHINE

FIELD OF THE INVENTION

The invention involves a doctor blade device for an ink cleaning unit of a rotary printing machine, consisting of a doctor blade support, provided with an ink channel, on which two parallel doctor blades that are adjustable in relation to a form inking roller are affixed—together with the form roller, the doctor blade support and packing pieces, which are made out of an elastomeric material and clamped adjacent to the doctor blade support, the doctor blades and form roller by the support—delimiting a closed ink compartment, and also consisting of lines for the transport of ink into and out of the ink compartment.

BACKGROUND OF THE INVENTION

In doctor blade devices of this type known in the art from DE 40 01 733 A1 and DE 195 16 224 A1, the packing pieces are inserted in recesses of covers which are screwed to the end faces of the doctor blade supports. The elastomeric material packing pieces on the end faces, however, are wear parts that must frequently be replaced. In order to replace them, the covers on the end faces must be unscrewed and, after inserting new packing pieces on the doctor blade support, screwed back onto the doctor blade support, each time, requiring relatively costly maintenance work.

SUMMARY OF THE INVENTION

The objective of the invention is to create a doctor blade device of the type specified in the introduction in which the packing pieces can be replaced quickly and easily.

According to the invention, this objective is accomplished with a doctor blade of the type specified in the introduction in which the packing pieces are held in their seats by clamping quick release closures.

The quick release closures provided according to the invention can be opened and closed easily and quickly by hand, or with a simple tool, without unscrewing and screwing back on covers or retaining piece, so that when a pieces wears out, it can be replaced more quickly and more easily.

Appropriately, the quick release closures are made out of swinging latches.

Each latch can be swivel-mounted on a pin at one of its ends on one side of each end face of the doctor blade support, and have on its other end an open-ended slot cutout with which it can latch behind the head of a bolt located on the other side of the end face of the doctor blade support. In order to guarantee a good secure seating of the packing pieces in their recesses, each latch can be pressed by a spring toward the end face of the doctor blade support.

Recesses functioning as seats for the packing pieces are machined into the end face of the doctor blade support for this purpose.

In another embodiment of the invention, intermediate plates are inserted between the outer sides of the packing pieces and the latches. These intermediate plates prevent the packing pieces made out of rubber or another elastomeric material from being damaged by the latch from its swinging action. Appropriately, the intermediate plates have end faces that are shaped the same as the end faces of the packing pieces.

The packing pieces can consist of molded parts with parallel sides which have roof-shaped inclined faces adjacent to the back sides of the doctor blades, and between them a cupped recess adjacent to the form roller.

BRIEF DESCRIPTION OF THE DRAWINGS

One embodiment of the invention is explained in greater detail with reference to drawings. In it is shown FIG. 1 a perspective view of a doctor blade device with a packing piece pulled out, intermediate plates shown separately and latch in its opened position, FIG. 2 an illustration corresponding to FIG. 1 in which the packing piece is inserted into its seat, FIG. 3 an illustration corresponding to FIGS. 1 and 2 in which the intermediate plate is moved toward its inserted position, FIG. 4 an illustration corresponding to FIGS. 1 through 3 in which the intermediate plate is inserted, and FIG. 5 an illustration corresponding to FIGS. 1 through 4 in which the latch is closed.

DETAILED DESCRIPTION OF THE PREFERRED EMBODIMENTS

Figure 1:
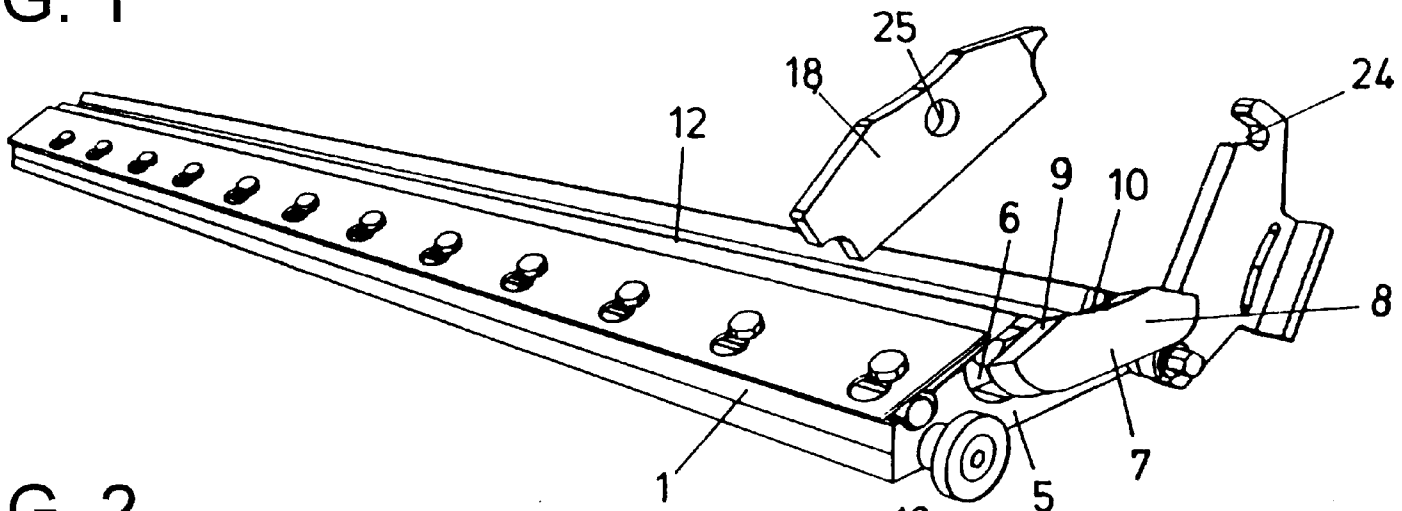
Figure 2:
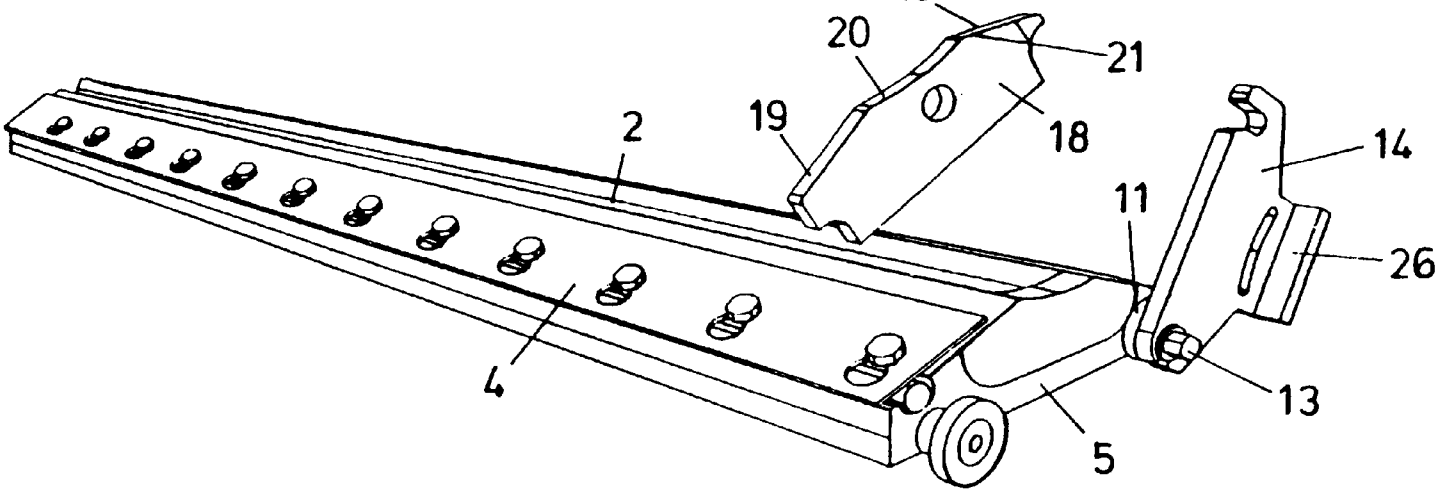
Figure 3:
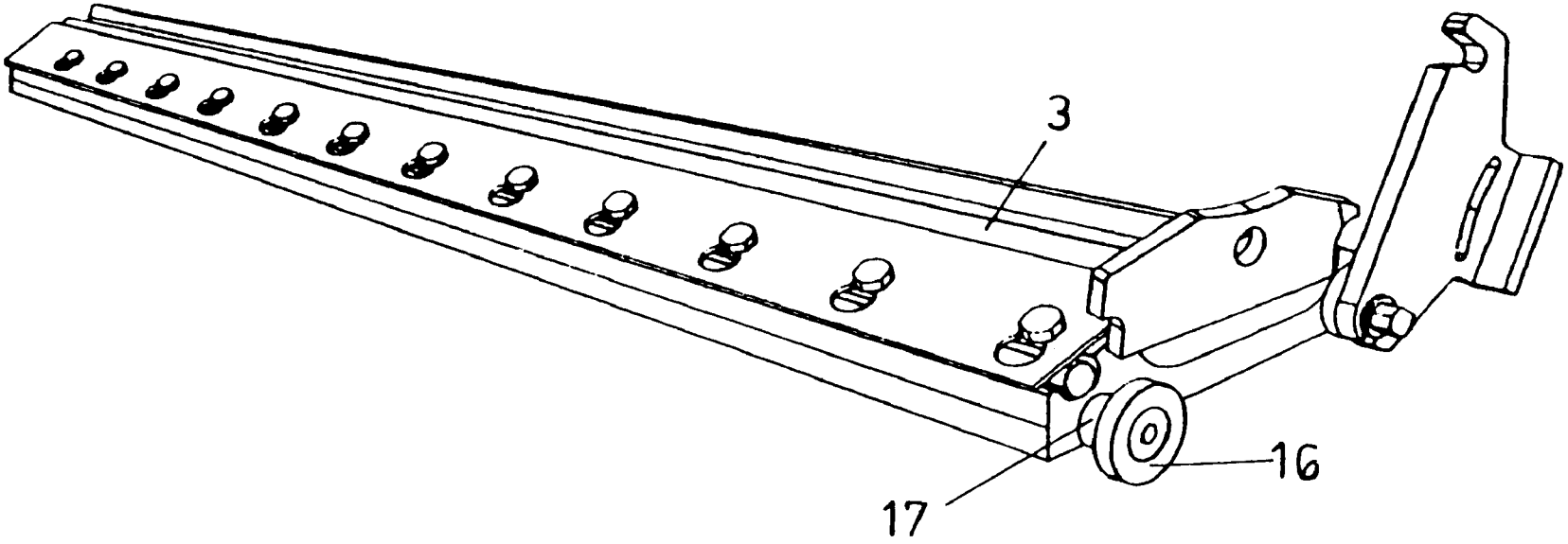

The doctor blade device consists of a boot shaped doctor blade support 1, which is provided with an average length ink channel 2. The doctor blade support 1 is provided with roof-shaped inclined surfaces 3 on both sides of the ink channel 2 on which clamping pieces are clamped, which fasten the doctor blades 12 in the usual manner.

The doctor blade supports 1 are provided on their end faces 5 with recesses 6 that correspond to the shape of the bottom parts of the packing pieces 7. The packing pieces 7 are made out of molded pieces with parallel sides 8. On their sides opposite the parts embedded in the recesses 6, the packing pieces 7 have roof-shaped inclined surfaces 9 and between these a cupped recess 10, the curvature radius of which corresponds to the form roller (not shown). The roof-shaped inclined surfaces 9 of the packing pieces are adjacent to the bottom sides of the doctor blades 12 held with the clamping pieces 4.

On one side of each end face, the doctor blade support has a bolt provided with a head 13, on which the latch 14, consisting of a somewhat trapezoidal shaped plate, is pivot-mounted through a hole. A ring 11 functioning as a support is affixed between the end face 5 and the latch 14 on the bolt. Relatively soft springs, which press the latch toward the end face 5, are inserted between the head 13 of the bolt and the latch 14. An additional bolt with a head 16 is screwed into the opposite side of each end face 5. These bolts have a shank part 17 between the end face 5 and the head 16, which functions as a support for the intermediate plate 18 like the ring 11. The intermediate plate has roof-shaped surfaces 19 and a cupped recess 20 on its upper edge, whereby its contours correspond to the end face sealing surfaces of the packing pieces 7. The plate 18 is provided with recesses 21 on its narrow sides, with which, in its inserted condition, it rests on the ring 11 and the shank part 17 that function as supports, as seen in FIG. 4.

Figure 4:
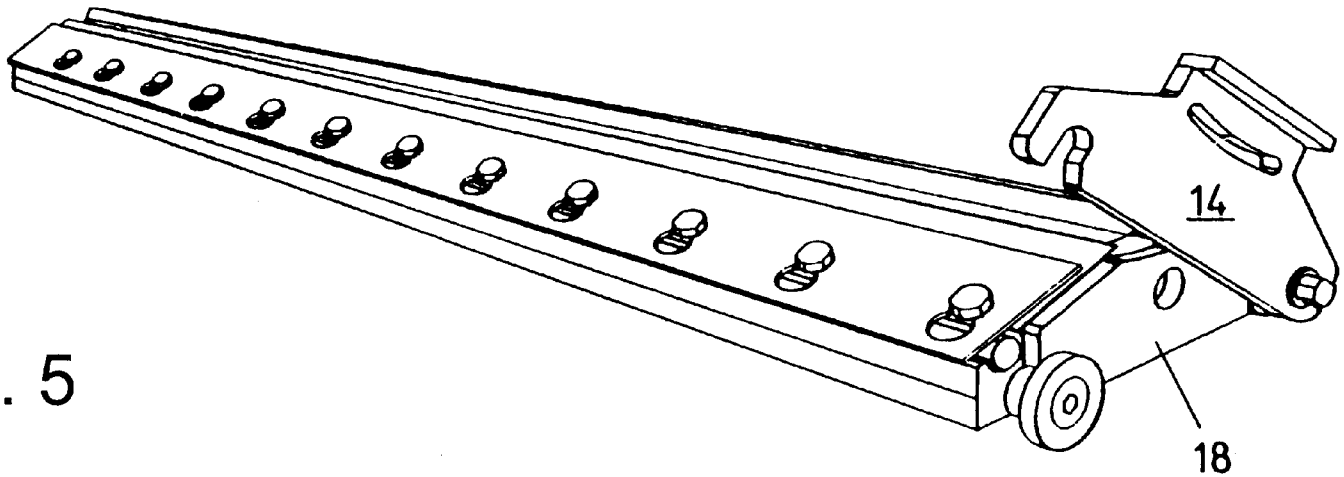
Figure 5:
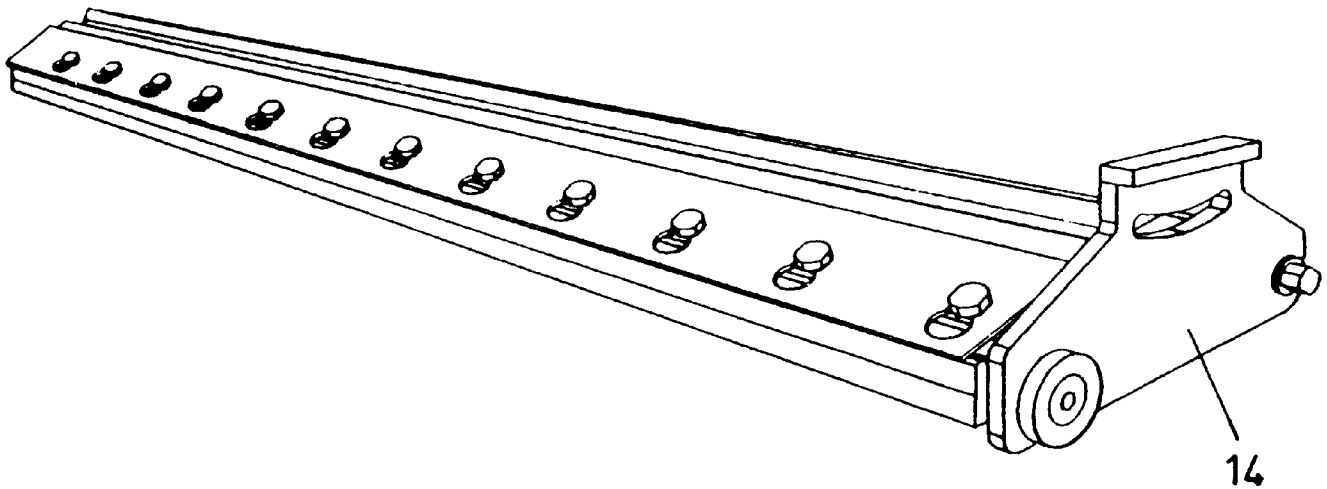

After inserting the intermediate plate 18 in the manner seen in FIG. 4, the latch 14 is swung into its closed position, seen in FIG. 5, in which it is hooked onto the shank of the bolt with its cut-out slot 24 in such a way that it grips behind the head 16. In its closure position seen in FIG. 5, the latch 14 lies adjacent to the intermediate plate 18 with spring pressure on it so that it secures each packing piece 7 in its recess 6.

The intermediate plate 18 is provided with a handle hole 25 for easier handling and removal.

The latch 14 is provided with an outward bend 26 on its upper side for handling.

We claim:

1. A doctor blade system of a rotary printing machine, said doctor blade system comprising:

a doctor blade support provided with an ink channel and recesses, two parallel doctor blades located on opposite sides of said ink channel, said doctor blades being adjustable in relation to a form inking roller, packing pieces made of an elastomeric material, said packing pieces being clamped adjacent to the doctor blades by the doctor blade support to delimit a closed ink compartment, clamping release latches, the packing pieces being held by said clamping release latches in said recesses, each latch being swivel mounted on a pin at one of its ends on one side of an end face of the doctor blade support, and having on an opposite end an open-ended slot cutout with which the latch is secured behind a head of a bolt located on the other side of the end face of the doctor blade support.

2. Doctor blade system as per claim 1, wherein the clamping release latches consist of swinging latches.

3. Doctor blade system as per claim 1, wherein the packing pieces include molded parts with parallel sides having roof-shaped inclined faces located adjacent to the doctor blades, and between the roof-shaped inclined faces, a cupped recess is located.

4. Doctor blade system as per claim 1, wherein each latch is pressed toward an end face of the doctor blade support.

5. Doctor blade system as per claim 1, wherein the recesses for the packing pieces are located in end faces of the doctor blade support.

6. A doctor blade system of a rotary printing machine, said doctor blade system comprising:

a doctor blade support provided with an ink channel and recesses, two parallel doctor blades located on opposite sides of said ink channel, said doctor blades being adjustable in relation to a form inking roller, packing pieces made of an elastomeric material, said packing pieces being clamped adjacent to the doctor blades by the doctor blade support to delimit a closed ink compartment, clamping release latches, the packing pieces being held by said clamping release latches in said recesses, and intermediate plates, with one plate located on each side of the doctor blade support, being inserted between an outer side of the packing pieces and the latches.

7. Doctor blade system as per claim 6, wherein the recesses for the packing pieces are located in end faces of the doctor blade support.

8. Doctor blade devices as per claim 6, wherein the packing pieces include molded parts with parallel sides having roof-shaped inclined faces located adjacent to the doctor blades, and between the roof-shaped inclined faces, a cupped recess is located.

9. Doctor blade system as per claim 6, wherein the clamping release latches consist of swinging latches.

10. Doctor blade system as per claim 6, wherein each latch is pressed toward an end face of the doctor blade support.

* * * * *